US007858860B1

(12) United States Patent
Dunnett

(10) Patent No.: US 7,858,860 B1
(45) Date of Patent: Dec. 28, 2010

(54) BASS DRUM SPRING ASSEMBLY

(76) Inventor: Ronn Dunnett, 4587 57th St., Delta, British Columbia (CA) V4K 3E4

( * ) Notice: Subject to any disclaimer, the term of this patent is extended or adjusted under 35 U.S.C. 154(b) by 0 days.

(21) Appl. No.: 12/539,019

(22) Filed: Aug. 11, 2009

Related U.S. Application Data

(60) Provisional application No. 61/087,910, filed on Aug. 11, 2008.

(51) Int. Cl.
*G10D 13/02* (2006.01)

(52) U.S. Cl. ..... 84/422.1

(58) Field of Classification Search ..... 84/411 R, 84/422.1, 422.3
See application file for complete search history.

(56) References Cited

U.S. PATENT DOCUMENTS 3,439,574 A 4/1969 Ramsey
3,722,349 A 3/1973 Hoellerich
3,930,431 A 1/1976 Magadini
4,567,808 A 2/1986 Smith
4,691,613 A 9/1987 Jacobson
4,747,333 A 5/1988 Hoshino
4,782,733 A 11/1988 Herring
6,166,312 A 12/2000 Brewster et al.
6,894,210 B1 * 5/2005 Lombardi ..... 84/422.1
2006/0156900 A1 7/2006 Dorfman et al.
2006/0156901 A1 7/2006 Dorfman et al.
2007/0295191 A1 12/2007 Dorfman et al.

* cited by examiner

*Primary Examiner*—Kimberly R Lockett
(74) *Attorney, Agent, or Firm*—Dwayne E. Rogge; Hughes Law Firm, PLLC

(57) ABSTRACT

A bass drum pedal assembly having a frame and a drive actuator where the drive actuator comprises an internal cam adapted to fit against a cam follower when the cam is operatively configured to return a striker to a neutral position where the drive actuator is modular in nature to be fitted to a frame.

8 Claims, 12 Drawing Sheets

BASS DRUM SPRING ASSEMBLY

RELATED APPLICATIONS

This application claims priority benefit of U.S. Ser. No. 61/087,910, filed Aug. 11, 2008.

BACKGROUND OF THE DISCLOSURE

Bass drum strikers have traditionally been integral-type members where springs and return mechanisms are very much integrated into the design. The prior art has failed to teach an integrated drive actuator which is modular in nature and configured to be fit upon a frame, such as a through shaft.

SUMMARY OF THE DISCLOSURE

A bass drum pedal assembly having a frame and a drive actuator where the drive actuator comprises an internal cam adapted to fit against a cam follower when the cam is operatively configured to return a striker to a neutral position where the drive actuator is modular in nature to be fitted to a frame.

The disclosure provides a bass drum pedal assembly having a base having a lower base portion, and a drive actuator mount portion. There is further a pedal movably attached to the base. A is mounted having striker having a drum impact portion. A drive actuator is implemented having a static housing portion which is operatively configured to attach to the drive actuator mount portion of the base. A biasing assembly has a cam follower configured to engage a cam rotatably mounted to the drive actuator mount portion of the base. The drive actuator has a rotating assembly comprising a crank having a crank arm extending radially outwardly and a beater housing operatively configured to have the striker attach thereto. The driver actuator further has a torque transfer shaft rotatably mounted to the static housing portion and a cam operatively configured to engage the cam follower of the biasing assembly whereas the cam positions the striker at a relaxed position where by depressing the pedal, the crank is rotated and repositions the biasing assembly into a higher energy state.

The drive actuator mount portion can have a through shaft extending substantially in a lateral direction The through shaft can be static during operation of the crank and the beater housing. The torque transfer shaft in one form allows the crank and the beater housing to be fixedly and adjustably mounted thereto at adjustment angles rotatably positioned around the torque transfer shaft. In this configuration the cam is operatively configured to be fit around a spring housing where the spring housing is fixedly and removably attached to a through shaft which is a part of the frame.

Further, a fastener adjusts a circumferential portion of the crank to provide movement of the crank with respect to the torque transfer shaft.

In other forms biasing assembly comprises a helical spring positioned in a biasing housing which is fixedly attached to the drive actuator mount portion by way of a through shaft. In this form an adjustment knob can be provided to adjust the length of the helical spring so as to adjust the tension of the cam follower pressed against the cam. Of course other assemblies and forms can be provided and covered by the claims.

DESCRIPTION OF THE PREFERRED EMBODIMENTS

Figure 1:
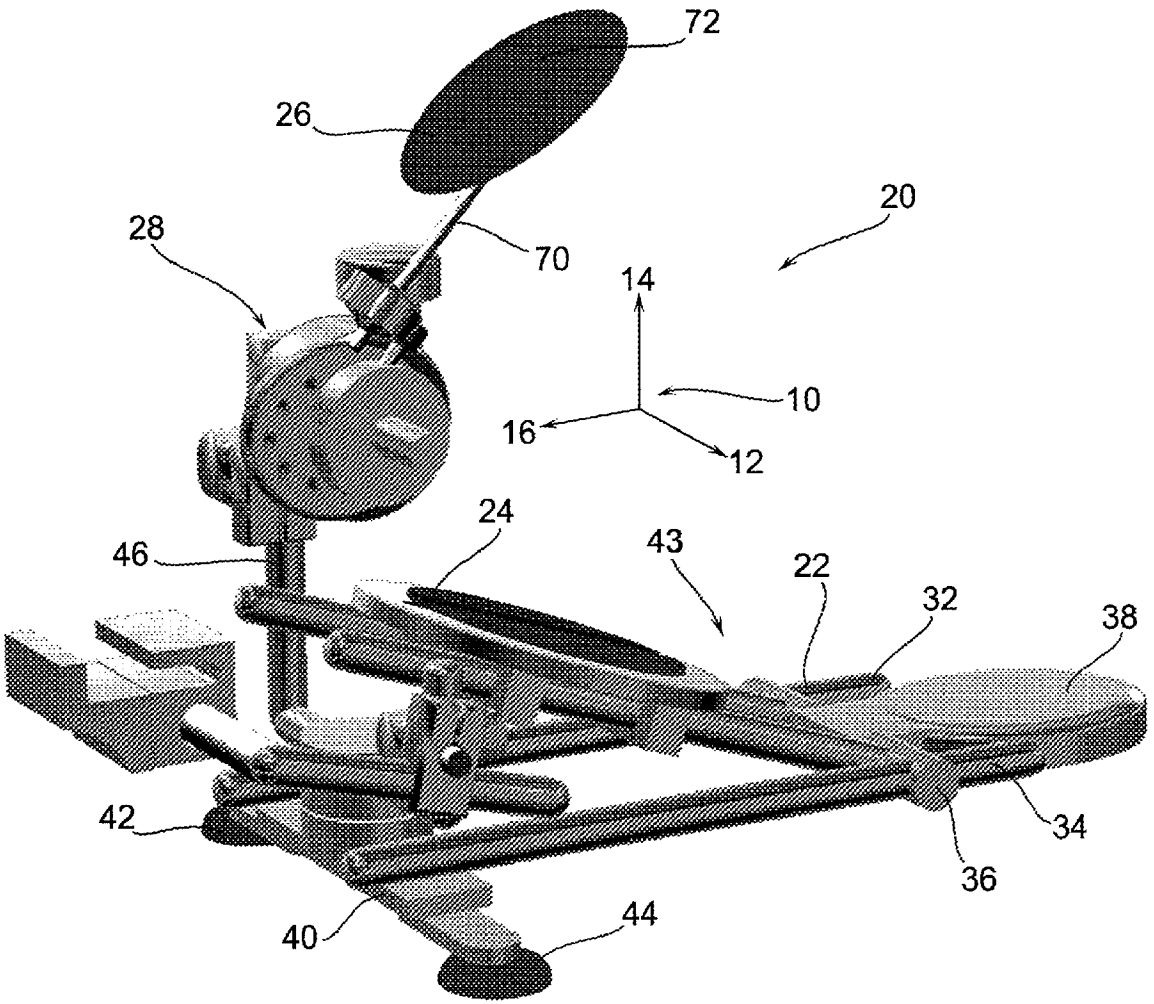
FIG. 1 shows an isometric view of a bass drum pedal assembly.

As shown in FIG. 1, there is a bass drum pedal assembly 20. Before further discussion, it should be noted that an axes system 10 is defined having a lateral axis 12 in a first lateral direction. Further, there is a vertical axis 14 and finally a longitudinal axis 16 pointed in a longitudinally forward direction. The axes are generally orthogonal to one another, but for purposes of description and reference thereto need not be perfectly orthogonal. However, the axes system 10 gives a general description of the orientation of the components as described in one form.

In general, the base drum pedal assembly 20 comprises a base 22, a pedal 24, a beater member 26 and a drive actuator 28. There will first be a general description of the base 22 followed by a description of the pedal 24 and beater member 26. Thereafter, a detailed description of the drive actuator 28 will be provided.

Figure 2:
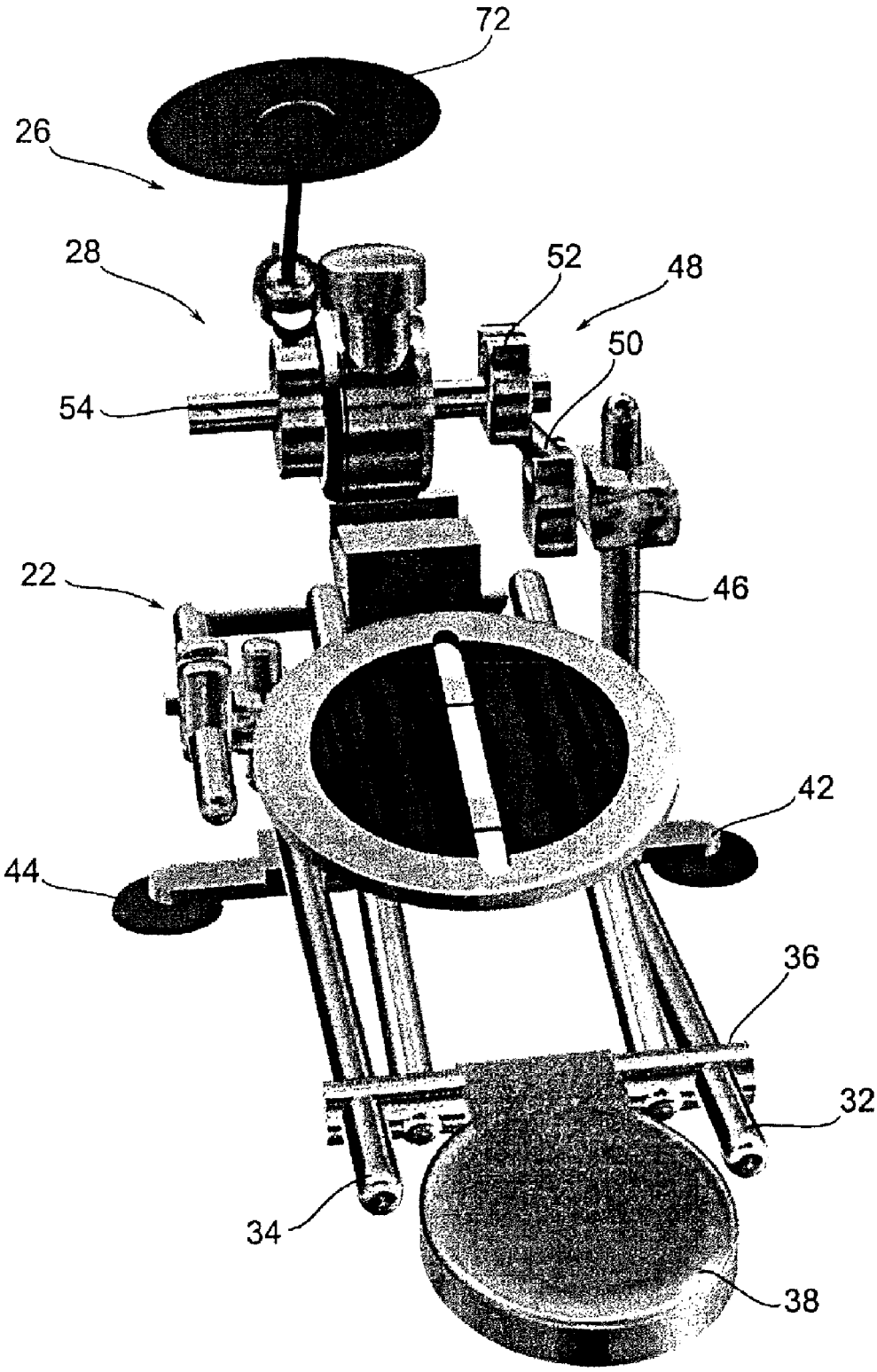
FIG. 2 shows an isometric view taken from a longitudinally rearward orientation.
Figure 3:
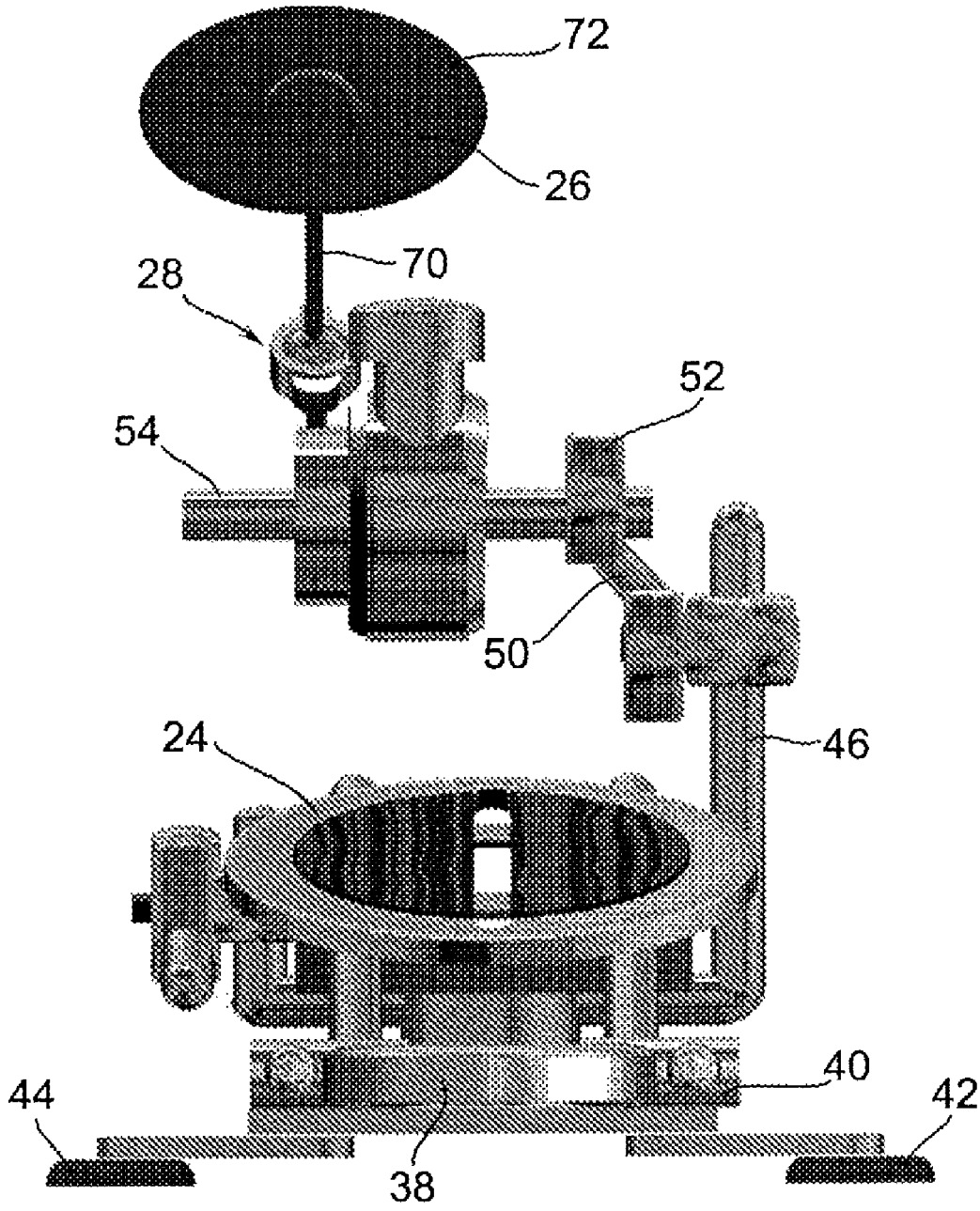
FIG. 3 shows a rear view taken along the longitudinal axis of the bass drum pedal assembly.
Figure 4:
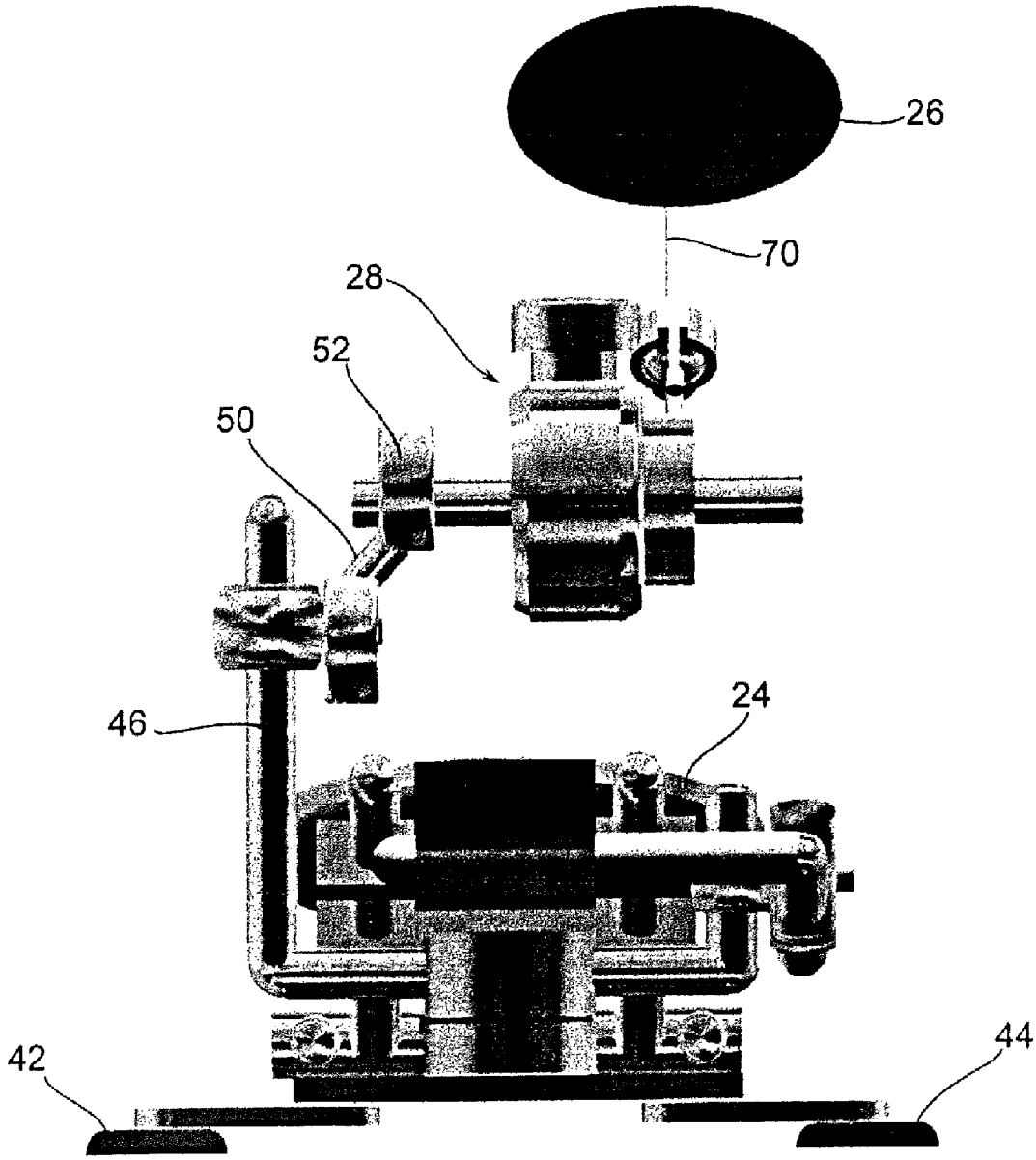
FIG. 4 is a view taken along the forward portion of the bass drum assembly substantially along the longitudinal axis.

As shown in FIG. 1 there is a base frame 22 having base longitudinally extending members 32 and 34. As shown in FIG. 2, the members 32 and 34 are attached to the lateral frame member 36 which is attached to a heel pad 38. As shown in FIG. 1, the forward portion of the base longitudinally extending members 32 and 34 is attached to a longitudinally forward mount portion 40. In general, the longitudinally forward mount portion 40 has ground-engaging features 42 and 44. Positioned in the longitudinally forward region in one form attached to the longitudinally forward mount portion 40 is the drive actuator mount portion 46 which is operatively configured to mount the drive actuator 28 thereto. As shown in FIG. 2, in one form, a connection assembly 48 is provided which can comprise a plurality of attachment members shown as 50 and 52. It should be noted that the base frame further includes the through shaft 54 which is configured to mount the drive actuator 28 thereto. It should also be noted that the through shaft 54 in a preferred form is static, meaning it is fixed or substantially fixed and is a part of the base 22.

The beater member 26 in general has a rod portion 7 which is operatively configured to be attached to the drive actuator 28. In general, the beater impact portion 72 can be of a variety of types and further, as described herein, a plurality of drive actuators 28 can be employed (for example) on the same through shaft 54 so as to have different strikers with different actuating type systems.

It should generally be noted in FIGS. 1-4 that in one form, some form of a tension member can be attached between the drive actuator 28 and the pedal 24 to provide a torque to the drive actuator.

With the foregoing description place, there will now be a detailed description of a drive actuator with reference to FIGS. 5-16.

In general, the drive actuator 28 comprises a biasing assembly 80, a static assembly 82, and a rotating assembly 84. It can be appreciated that the static assembly is effectively connected to the through shaft 54 and the rotating assembly is configured to rotate therearound.

Figure 6:
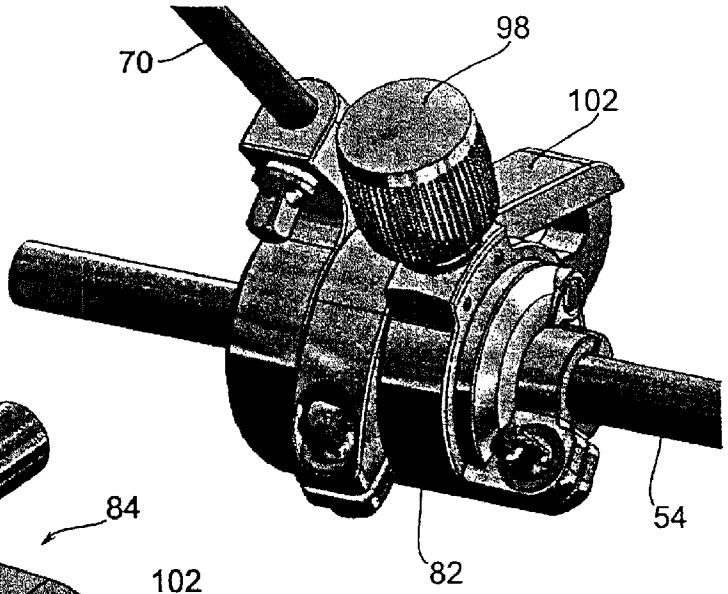
FIG. 6 is an isometric view of the drive actuator which is mounted upon a through shaft.
Figure 5:
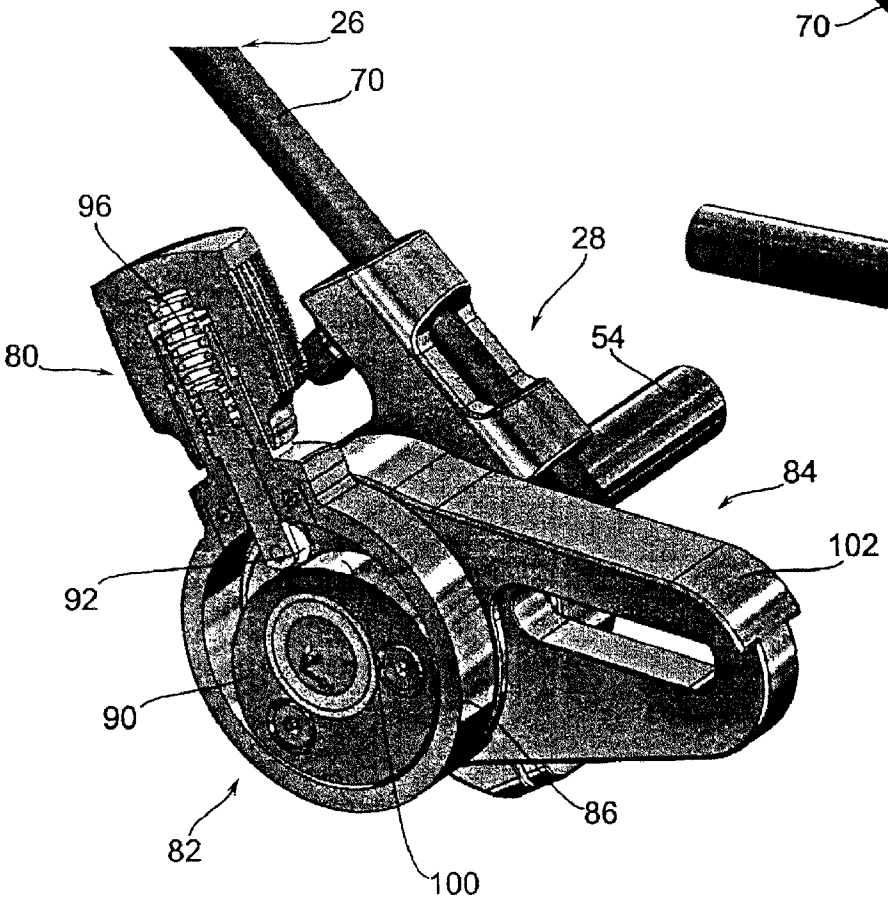
FIG. 5 is an isometric view with a partial cutaway showing the biasing assembly and an internal cam member.
Figure 7:
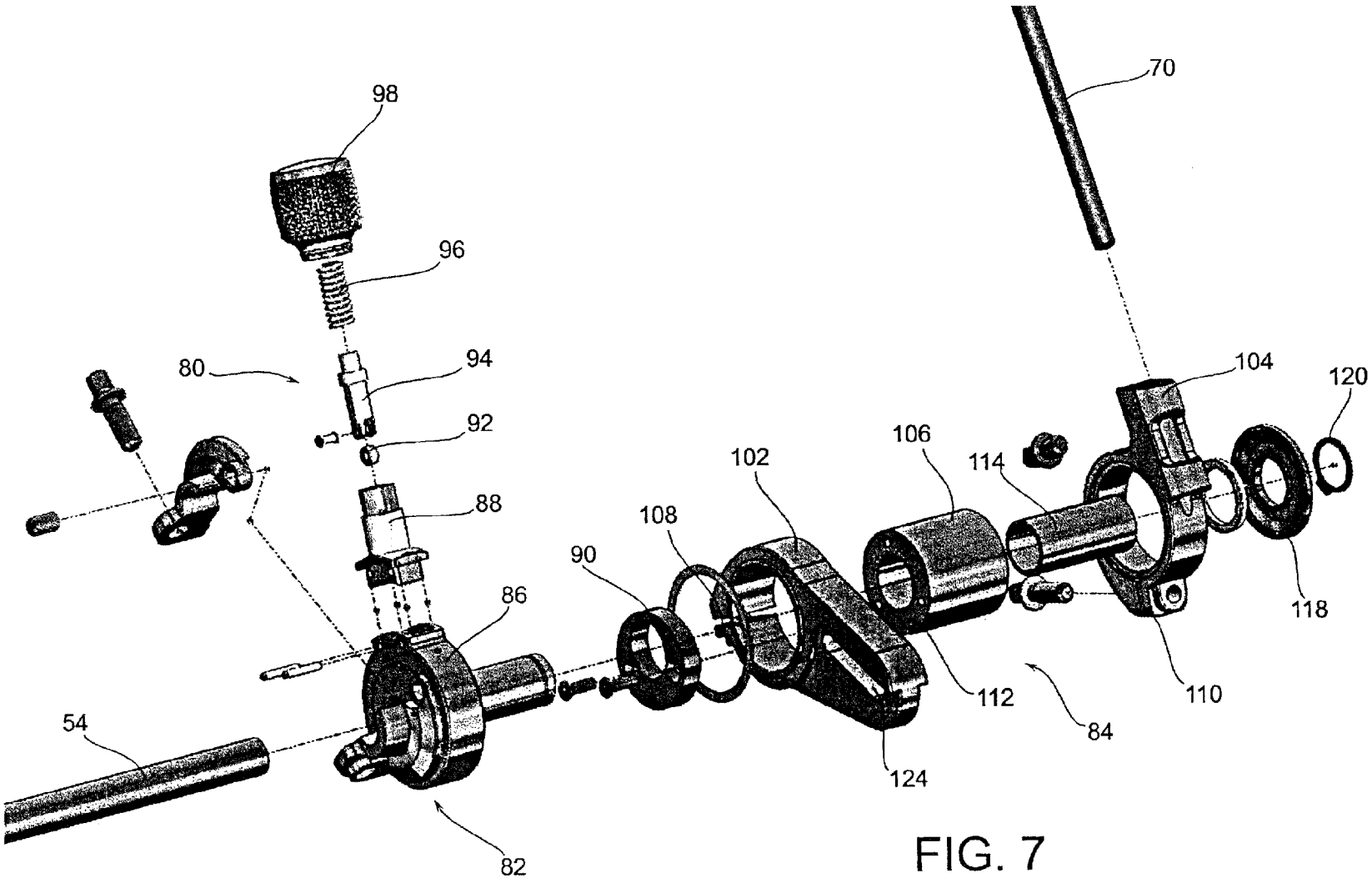
FIG. 7 shows an exploded view of the drive actuator.

Referring to FIG. 6, it can be appreciated that the static assembly 82 is provided and FIG. 5 shows the interior portion of the biasing assembly 80. As shown in FIG. 7, in general the left-hand portion approximately left of the cam 90 is the static assembly, and the right-hand portion generally comprises the rotating assembly 84. Still referring to FIG. 7, you can see the cam housing which is configured to have the cam 90 mounted therein. Of course it should be noted that the assembly exploded view as shown in FIG. 7 is only one form of carrying out the underlying teachings as claimed herein. In general, the biasing assembly 80 is mounted to the cam housing 86 where the lower housing member 88 is provided, and a cam follower 92 is movably attached to the rod 94, which is biased by the biasing member 96. In one form the biasing member 96 can be a helical spring, but in the broader scope can be any type of biasing member such as an air piston, or any kind of compressive device or even a tension member. Further, in the broader scope the biasing member 96 can further be, for example, an array of springs customized by the user. In one form, the springs can be compressive in design. For example, a spring will max out its compression and an adjacent spring having a different spring constant would thereby be fully invoked. The adjustment knob 98 is one form of adjustment system to adjust the compressive preset tension upon the biasing member 96 which again in one form is a helical spring. The cam 90, as for example shown in FIG. 5, has a cam surface 100 which changes in distance with respect to rotation. In other words, the center of rotation of the cam which coincides at the center axis of the through shaft 54 is such that the cam surface increases its radial length therefrom as the cam rotates. As described further herein, the cam moves in conjunction with the rod portion 70 of the beater member 26. Therefore, the force from the cam follower 92 imparted upon the cam surface 100 is such to bring the striker back to a neutral position as that is shown in FIG. 5.

Figure 9:
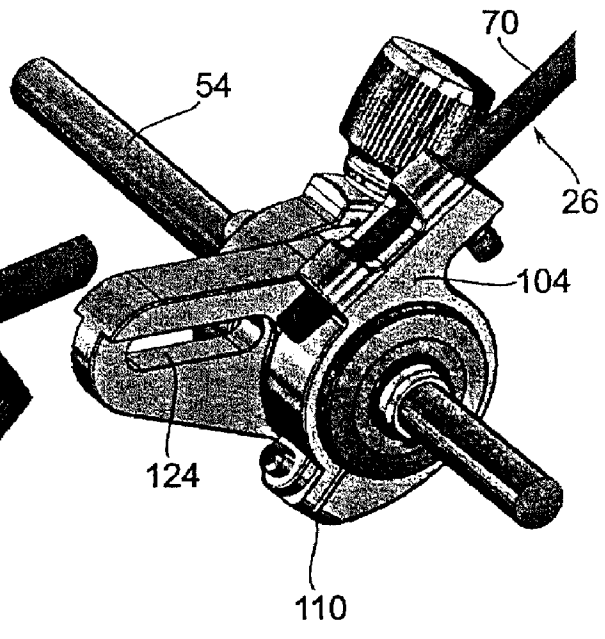
FIG. 9 shows an isometric view of the drive actuator showing the crank in a longitudinally forward extending orientation.
Figure 8:
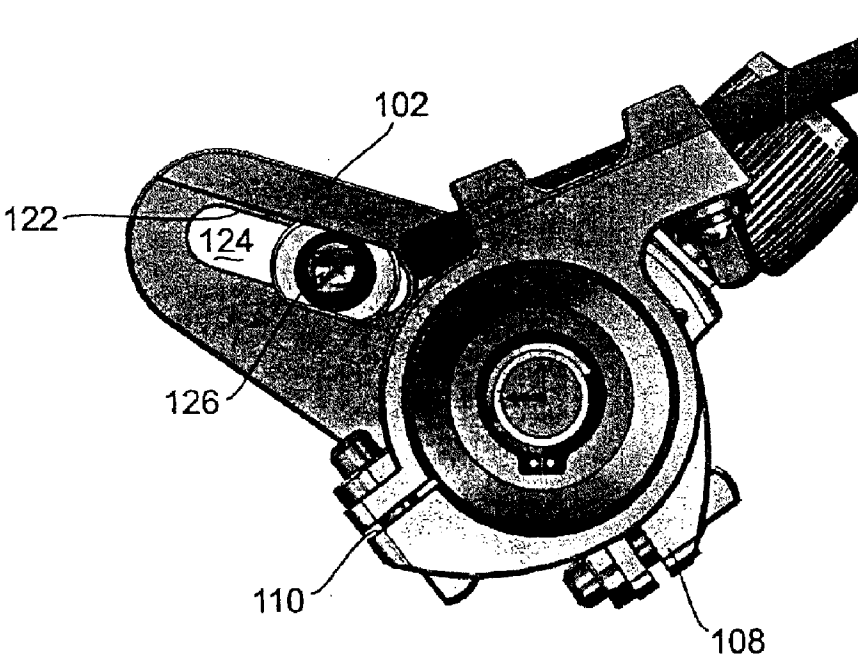
FIG. 8 shows a side view along the lateral axis in the second direction of the drive actuator.
Figure 10:
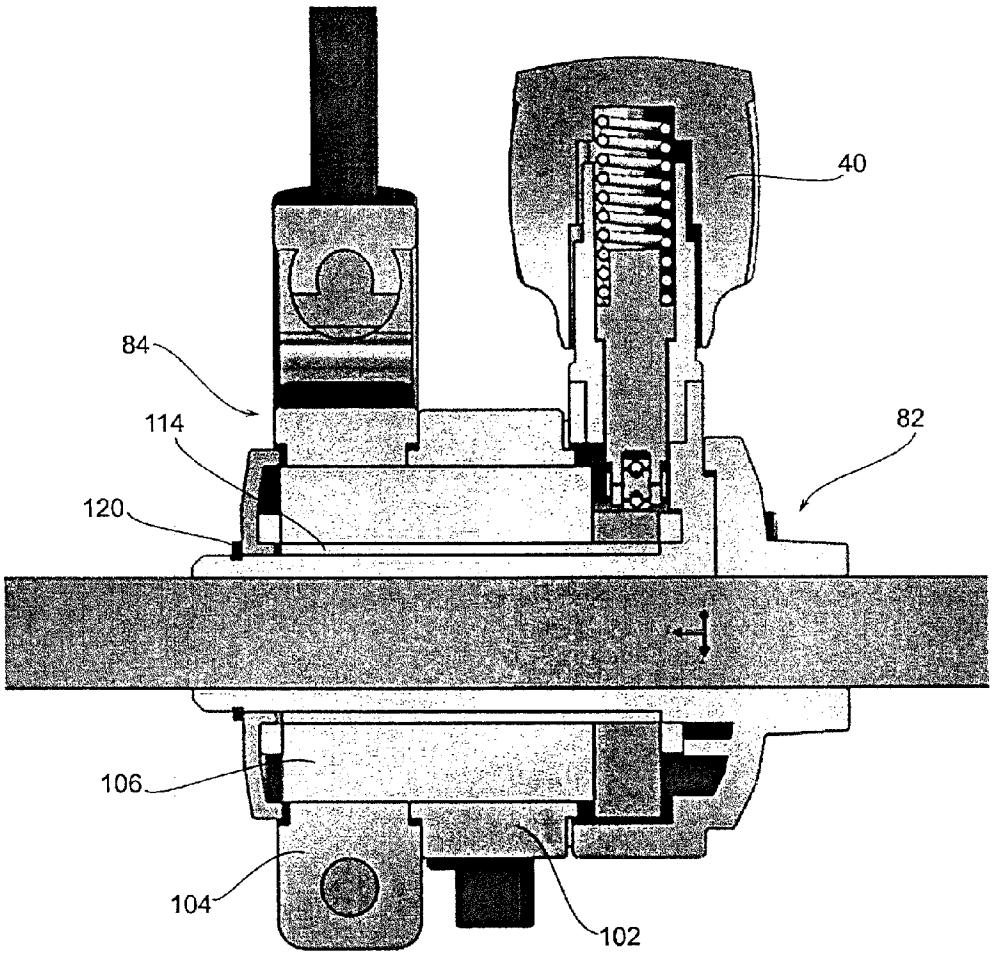
FIG. 10 shows a sectional view of the drive actuator showing more specifically the biasing assembly, the static frame assembly and a rotating assembly.

Referring now to FIG. 7, it can be seen that there is a crank 102 and a beater housing 104, which in one form are configured to be mounted about a torque transfer shaft 106. Therefore, these members 102 and 104 can be rotatably adjusted around the torque transfer shaft by an adjustment system 108 and 110 which can be, for example, a circumferential-type clenching member like a bolt-and-nut assembly. Of course, other types of rotational adjustment mechanisms can be employed. The torque transfer shaft has a mount region 112 in one form which is operatively configured to mount the cam 90 thereto. Further, the bushing member 114 can be copper or derived of some other type of bushing material which acts as a bearing to allow the torque transfer shaft 106 to rotate therearound. An end cap 118 can be employed along with a circular clip 120. Of course, the exploded view in FIG. 7 again is only one type of embodiment, and any number of components could be combined or split up in the further subassemblies and subcomponents to create a multitude of embodiments. As shown in FIG. 8, there is a side profile view showing the crank 102 where it can be appreciated that a surface 122 defining an adjustment slot 124 is provided. In general, the attachment portion 126 is operatively connected to the pedal 24 (see FIGS. 1-4) so as to apply a downward force thereupon. FIG. 9 shows an isometric view where, for example, the orientation of the adjustment slot 124 is at a desired substantially perpendicular location with respect to the position of the rod portion 70 of the beater member 26. FIG. 10 shows a cross-sectional view of the various components and it generally can be appreciated which portion is the static frame assembly 82 and which regions are defined by the rotating assembly 84. Therefore, the bushing 114 provides a barrier-like effect around the torque transfer shaft 106.

Figure 11:
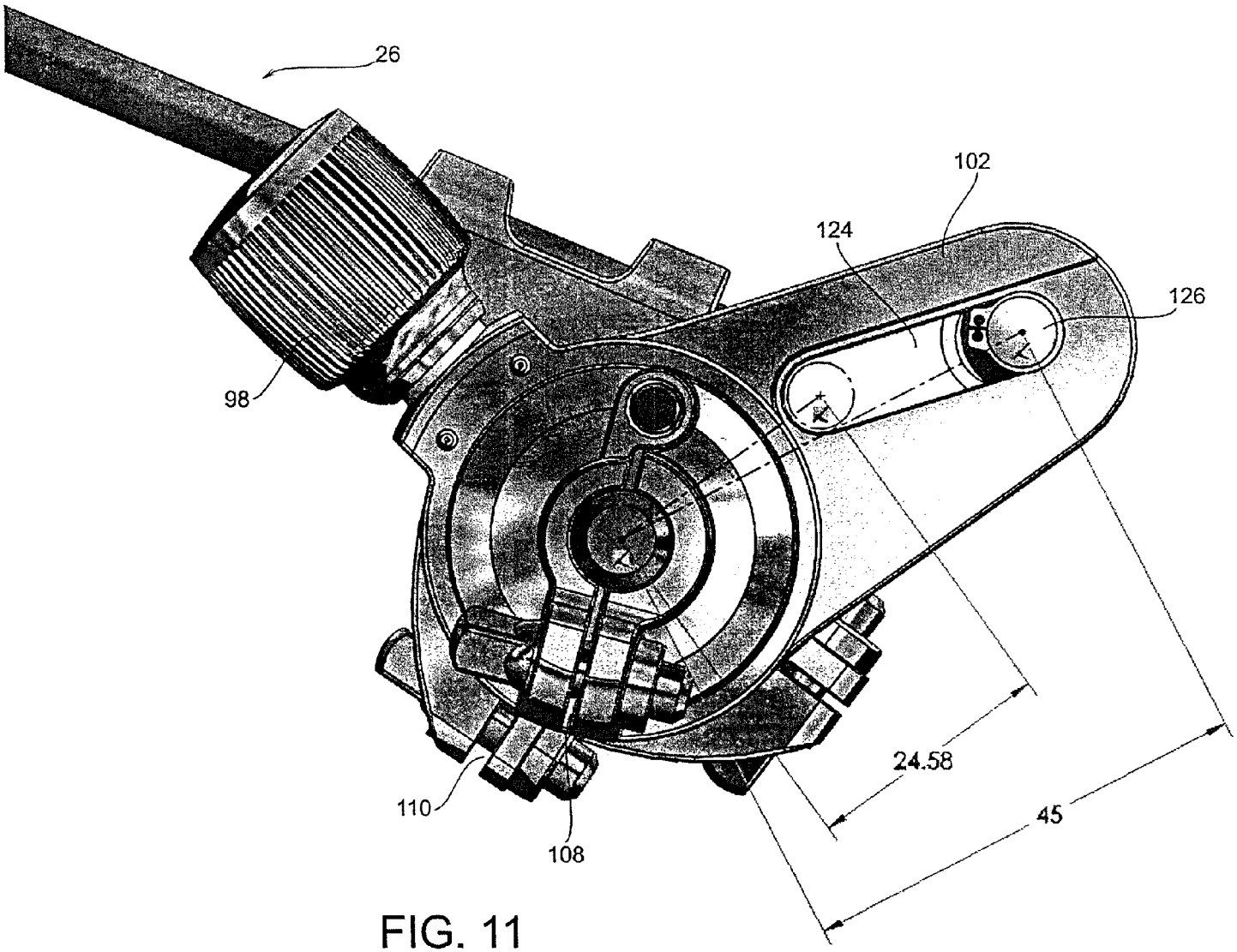
FIG. 11 shows a side view of the drive actuator at a substantially opposed lateral view as to that shown in FIG. 8.

FIG. 11 shows a substantially lateral opposing view to that which is shown in FIG. 8. In general, it can be appreciated that the attachment portion 126 can be positioned at a radially further outward orientation along the crank 102. Of course it can be appreciated that having a further distance from the center of rotation allows for a greater foot pedal movement to move the striker the same rotational distance, although there will be greater leverage thereupon.

Figure 13:
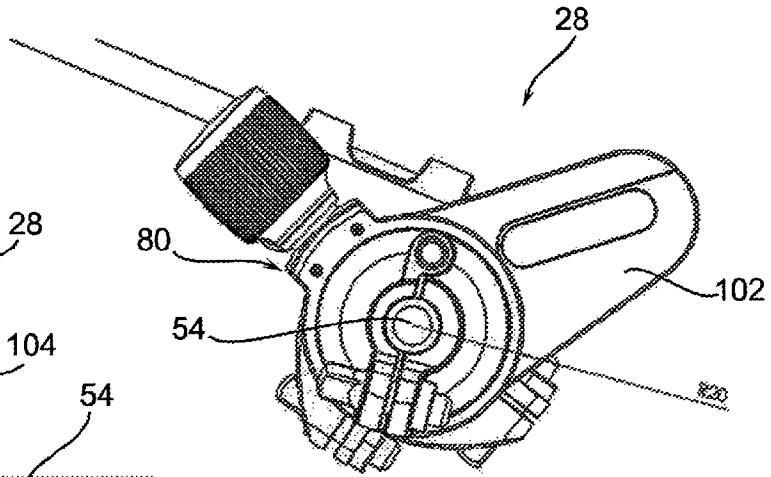
FIG. 13 and FIG. 14 show alternative lateral views of the drive actuator.
Figure 14:
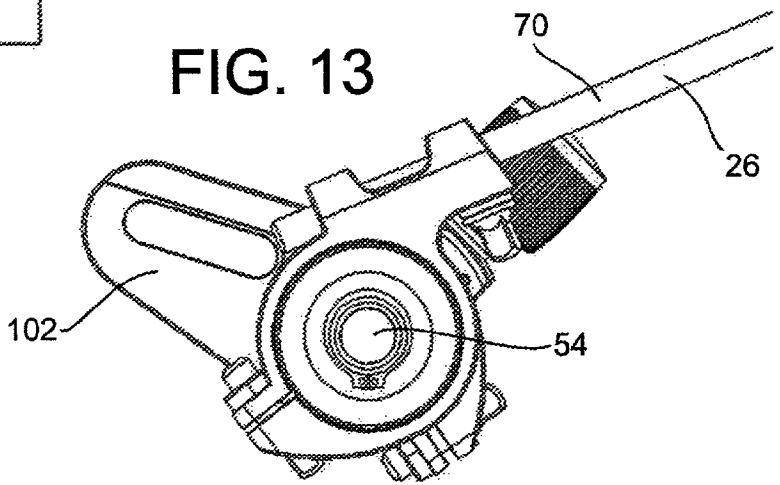
Figure 12:
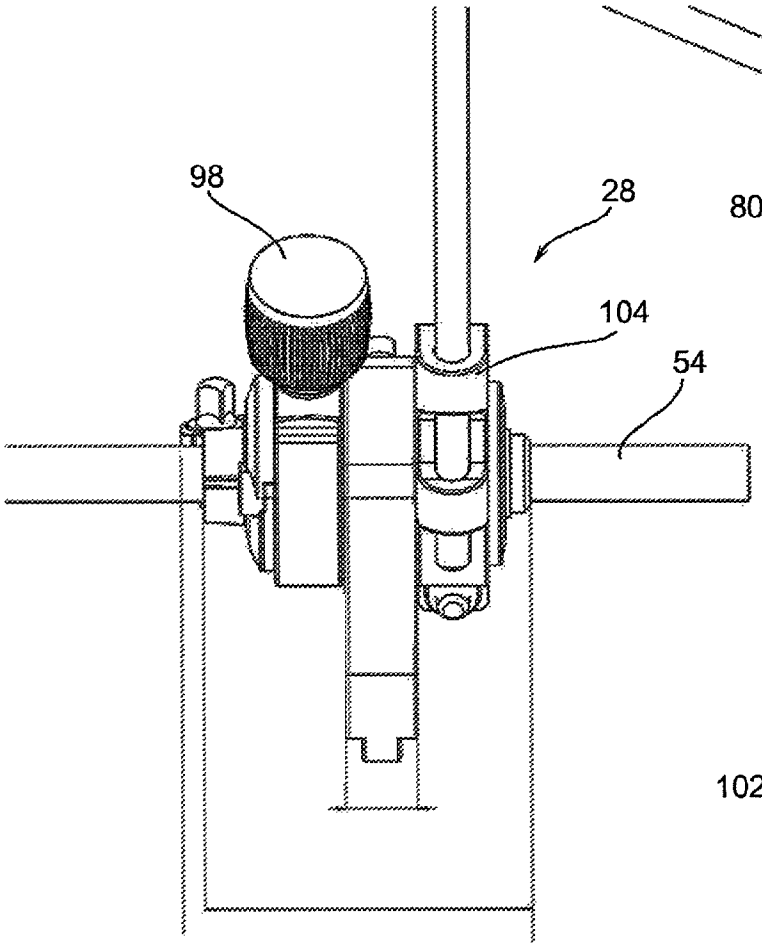
FIG. 12 shows a partially top view of the drive actuator.
Figure 16:
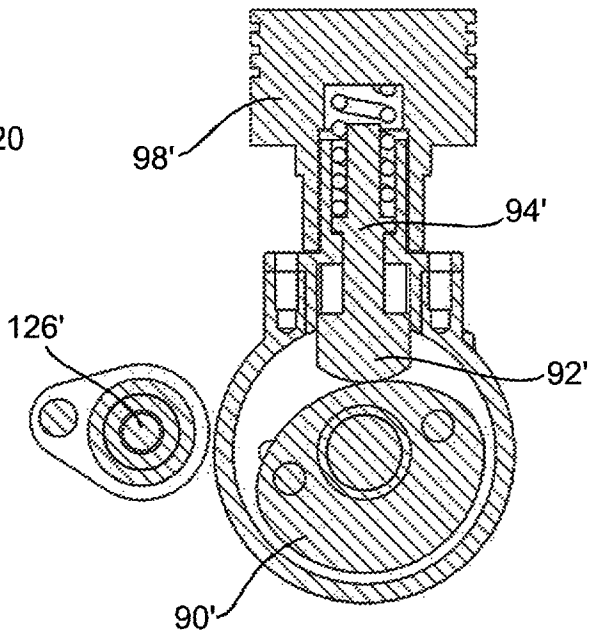
FIG. 16 shows a sectional view taken along line 16-16 of FIG. 15.
Figure 15:
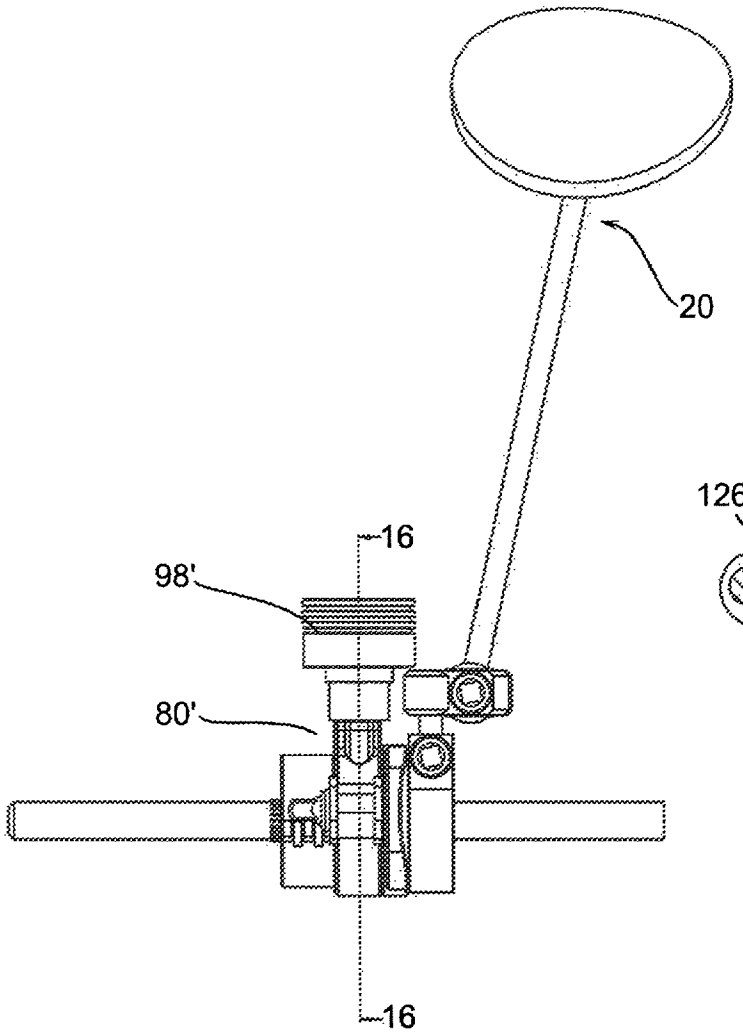
FIG. 15 shows a front view of another slightly different embodiment of a drive actuator.

FIGS. 12-14 show additional views of the drive actuator 28. FIGS. 15 and 16 show a view with a slightly different configuration. The adjustment knob 98' is of a slightly greater diameter, but in the same form is operatively configured to adjust an internal spring in the biasing assembly 80'. FIG. 16 shows a sectional view taken at line 16-16 of FIG. 15, and in this form the cam 90' is shown where the cam follower 92' is integral with the rod 94' as further shown in the cross-sectional view, and the attachment portion 126' is provided and substantially in line with the cam in a longitudinal direction.

Therefore, it can be appreciated that the drive assembly 28 is operatively configured to be very modular, and a plurality of drive assemblies can be mounted to a frame such as the through shaft 54. Further, the drive assembly need not necessarily be activated by a foot pedal, but any type of actuating systems such as a cable embedded within an exterior insulated cable or otherwise torqued or driven by a mechanical device operated by a human or automated. It should further be noted that the through shaft is a static member and does not rotate, and does not need to be mounted by bearings or any other such type of rotational support. Further, having a through shaft which in one form is cylindrical, but of course could take other cross-sectional shapes, is advantageous because, as noted above, this allows the drive actuator to be extremely modular in nature. Above it was noted that the springs can be adjusted, but further the modular nature of the unit allows for different cam members to be inserted therein with different cam surfaces, and further other components to be swapped out and changed in a very convenient interchangeable matter.

Figure 17:
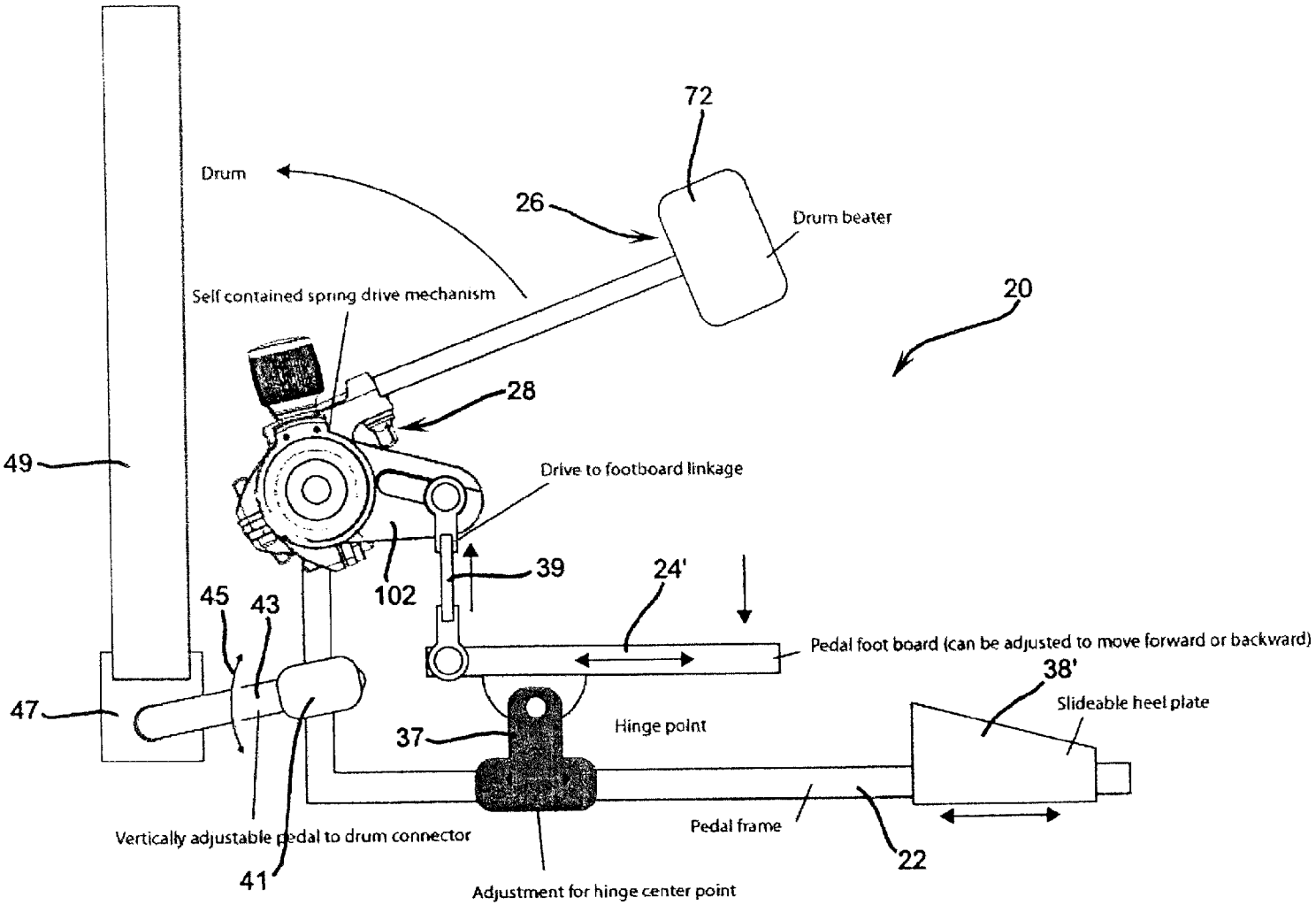
FIG. 17 shows a side view of the pedal assembly.

Referring to FIG. 17, there is shown another embodiment of the pedal indicated at 24'. In general, in this form, the heel plate 38' is generally slidably attached to the frame otherwise referred to as the base 22. However, the pedal 24' in this form is pivotally attached at the hinge point 37 and positioned in the forward portion of the pedal 24' is the connecting member 39. The connecting member 39 is configured to operate in compression (as opposed to in tension) upon the drive actuator 28.

It can further be appreciated that the crank 102 can be repositioned about the torque transfer shaft so as to operate in the manner as show in FIG. 17. Therefore, it can be appreciated that the lever system as shown in FIG. 17 of the pedal 24' operates as a first-class lever. Of course, other type of leverage assemblies and mechanisms can be employed to operate the drive actuator 28.

It should further be noted that the drive actuator 28 is inherently modular whereby the connection assembly 48 as shown for example in FIG. 2 is configured to raise and lower the drive actuator 28, and in turn the beater member 26. As shown in FIG. 17, attached to the base 22 is the mount 41 which in turn is fixedly and repositionably connected to the base, and the mount 41 is connected to a drum connecting support arm 43, which can further rotate as indicated by the arrow 45. The longitudinally forward portion of the arm 43 is connected to a drum attachment 47 which is configured to attach to the schematic front portion of the drum 49. In the prior art, there are certain attachments which raise, for example, a smaller drum. The raising of the drum can be required so that the drum impact portion, the beater impact portion 72, impacts the drum 49 at a correct vertical location. Therefore, it can be appreciated that the drum-connecting support arm 43 allows for this adjustment of the drum and further attaches the drum pedal assembly 25 to the drum. Further, as described above in FIG. 2, the connection assembly 48 provides another form of adjustment where the modular aspects of the drive actuator are present to allow such repositioning of the beater impact portion 72. It should be noted that the drum connecting support arm 45 also can provide movement in the lateral direction to provide correct lateral positioning of the drum pedal assembly 20 with respect to the drum 49.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A bass drum pedal assembly comprising:

a. a base having a lower base portion, and a drive actuator mount portion, b. a pedal movably attached to the base, c. a striker having a drum impact portion, d. a drive actuator having a static housing portion which is operatively configured to attach to the drive actuator mount portion of the base, e. a biasing assembly having a cam follower configured to engage a cam rotatably mounted to the drive actuator mount portion of the base, the drive actuator further comprising:

i. a rotating assembly comprising a crank having a crank arm extending radially outwardly, ii. a beater housing operatively configured to have the striker attach thereto, iii. a torque transfer shaft rotatably mounted to the static housing portion, iv. a cam operatively configured to engage the cam follower of the biasing assembly whereas the cam positions the striker at a relaxed position where by depressing the pedal, the crank is rotated and repositions the biasing assembly into a higher energy state.

2. The base drum pedal assembly as recited in claim 1 where the drive actuator mount portion comprises a through shaft extending substantially in a lateral direction.

3. The base drum pedal assembly as recited in claim 2 where the through shaft is static during operation of the crank and the beater housing.

4. The base drum pedal assembly as recited in claim 1 where the torque transfer shaft allows the crank and the beater housing to be fixedly and adjustably mounted thereto at adjustment angles rotatably positioned around the torque transfer shaft.

5. The base drum pedal assembly as recited in claim 4 where the cam is operatively configured to be fit around a spring housing where the spring housing is fixedly and removably attached to a through shaft which is a part of the frame.

6. The base drum pedal assembly as recited in claim 5 where a fastener adjusts a circumferential portion of the crank to provide movement of the crank with respect to the torque transfer shaft.

7. The base drum pedal assembly as recited in claim 1 where the biasing assembly comprises a helical spring positioned in a biasing housing which is fixedly attached to the drive actuator mount portion by way of a through shaft.

8. The base drum pedal assembly as recited in claim 7 where an adjustment knob is provided to adjust the length of the helical spring so as to adjust the tension of the cam follower pressed against the cam.

* * * * *